US005186575A

United States Patent [19]

Wirtgen

[11] Patent Number: 5,186,575

[45] Date of Patent: Feb. 16, 1993

[54] PLANING DEVICE FOR PLANING DOWN ROAD SURFACES

[76] Inventor: Reinhard Wirtgen, Hohner Strasse 2, D-5469 Windhagen, Fed. Rep. of Germany

[21] Appl. No.: 727,078

[22] Filed: Jul. 9, 1991

[30] Foreign Application Priority Data

Jul. 12, 1990 [DE] Fed. Rep. of Germany ..... 4022034

[51] Int. Cl.[5] ..... E21C 13/00

[52] U.S. Cl. ..... 404/96; 198/676; 299/93

[58] Field of Search ..... 404/96, 112; 198/676; 299/87, 93

[56] References Cited

U.S. PATENT DOCUMENTS

| | | | |
|---|---|---|---|
| 3,282,446 | 11/1966 | Laidig | 198/676 X |
| 3,498,479 | 3/1970 | Weaver et al. | 198/676 X |
| 4,057,294 | 11/1977 | Kiekler | 299/93 |
| 4,340,256 | 7/1982 | Hart | 299/87 |
| 4,609,227 | 9/1986 | Wild et al. | 299/93 |
| 5,052,757 | 10/1991 | Latham et al. | 299/87 |

FOREIGN PATENT DOCUMENTS

| | | | |
|---|---|---|---|
| 3339558 | 5/1985 | Fed. Rep. of Germany | 299/93 |

*Primary Examiner*—William P. Neuder
*Attorney, Agent, or Firm*—W. Thad Adams, III

[57] ABSTRACT

The invention concerns a planing device for planing down road surfaces, having a roller-type, rotatably supported planing body designed in the form of a conveyor worm 3, the planing body having a multiplicity of planing tools which are arranged in releasable retention boxes 1 which are in turn bolted by means of their shank parts 4 in radial recesses 2, open at the side, it being possible to fasten at least one retention block 8 at least partially covering the shank part 4 by bolts 9 penetrating through the conveyor worm 3 in order to retain the shank part 4 of the retention box 1 in the side opening 2.

In order to change the retention boxes, it is then only necessary to loosen the fastening bolts 9 of the retention block 8.

10 Claims, 1 Drawing Sheet

PLANING DEVICE FOR PLANING DOWN ROAD SURFACES

BACKGROUND OF THE INVENTION

1. Field of the Invention

The invention concerns a planing device for planing down road surfaces, having a roller-type, rotatably supported planing body designed in the form of a conveyor worm, the planing body having a multiplicity of planing tools which are arranged in releasable retention boxes whose shank parts are in turn bolted in radial recesses, open at the sides, in the conveyor worm.

2. Discussion of Background

A device of this type with retention box shaft parts fastened in such a manner is known, for example, from the applicant's own previous German patent application P 39 09 695.5.

Both the rotating shank-type tools located in the retention boxes and the retention boxes themselves are subject to extremely severe abrasion when the planing machine is in operation.

It is therefore not only necessary to exchange the easily replaceable rotating shank-type tools; it is also necessary to exchange the retention boxes at certain intervals and to replace them with new retention boxes.

In this previously known embodiment, the retention bolts must be completely released in order to remove the shank parts of the retention boxes from the radial recesses, open at the side, in the conveyor worm and to replace them by new retention boxes.

Given the large number of planing tools located on the planing roller, this involves a very time-consuming operation whenever such an exchange of the retention boxes is necessary.

SUMMARY OF THE INVENTION

Starting from this known state of the art, one object of the present invention is to improve a planing device, of the type defined at the beginning, in such a way that the machine setting-up times are greatly reduced and the operational economics substantially improved.

This object of the invention is achieved by means of a planing device of the type defined at the beginning wherein, in order to retain the shank part of the retention boxes in the side opening, at least one retention block extending at least partially over the shank part can be fastened by bolts penetrating through the conveyor worm.

In this embodiment of the invention therefore, in contrast to the previously known embodiment, it is not the shank part but a retention block at least partially extending over the shank part which can be fastened by means of the bolts penetrating through the conveyor worm and which can therefore hold the shank part securely in the radial recess in the bolted-up position of the retention block.

In accordance with the invention, it is only necessary to loosen the retention block in order to release the shank part. The shank part of the retention box can then be withdrawn in the radial direction from the recess.

Conversely, the shank part of the new retention box can be inserted in the radial recess and held securely in the recess by bolting up the retention block.

The retention bolts, which penetrate through the conveyor worm, need only be loosened by one or two turns in order to release the shank part. In consequence, only a minimum amount of fitting work is necessary to replace the individual retention boxes.

The shank part of the retention boxes is then held either by means of two retention blocks which restrain each side of the shank part inserted in the radial recess or by means of only one retention block, the other side then being held by its design providing a form fit with the recess.

Intrinsically, any design of the one side of the shank part to give a form fit with the wall of the recess can be used. Thus, for example, the recess side wall can have, in its turn, an approximately semicircular recess into which the correspondingly shaped side of the shank part is fitted. Another embodiment, which is particularly advantageous with respect to manufacture, uses a shank part which is bounded by surfaces at right angles to one another on the side facing away from the retention block. In conjunction with the form-fit design of recess, the shank part is held in the recess securely and immovably by the bolted retention block.

The design of the retention block is preferably such that it extends at least partially over the shank part and so fastens it immovably.

It has been found particularly desirable to insert the retention block as a wedge between the side wall of the radial recess and the shank part and to clamp it by means of the retention bolts. Optimum fastening is achieved by this means.

In addition, such an embodiment offers the possibility of compensating for manufacturing tolerances in the shank part of the retention box because only the side of the shank part facing away from the retention block determines the exact arrangement of the shank part and hence of the retention box with the planing tool.

In consequence, it has been found very desirable for the shank part to have a quadrilateral shape in section, the side facing towards the worm being longer than the side facing away from the worm. By designing the side of the shank part facing away from the retention block to be a form fit with the adjacent side of the recess and by using a wedge-shaped retention block, which is clamped by means of the fastening bolts, the shank part can be clamped accurately against the side and rear walls of the recess and securely fastened even if large manufacturing tolerances are present.

Although, in such an embodiment, the narrow side of the retention shank protruding from the recess is of less importance to the fastening, a design of the retention shank which is trapezoidal in section and in which the side in contact with the rear wall of the recess and the front narrow side are parallel to one another is to be preferred for manufacturing reasons.

In another advantageous embodiment, the front narrow side of the retention shank is provided, at least partially, with a protrusion, which may possibly be rounded, by means of which the resistance to abrasion of the retention shank is prolonged.

In accordance with the most favored embodiment of the planing device according to the invention, the shank part has a section which is a trapezium with two adjacent right-angle corners which is so arranged in the cuboid section recess that the narrow side is directed away from the worm, the adjacent side at right angles represents the back of the retention shank viewed in the direction of rotation and the retention block is fitted and can be bolted in as a wedge-shaped form fit between the recess wall and the shank part.

In such an embodiment, the radial, rectangular section recess can be easily produced without undercuts being necessary. In addition, the retention shank of the retention box which has to be inserted in this recess—and which has no undercutting of any sort-can also be produced without difficulty by automatic manufacturing methods.

The retention block, which is fitted and bolted in as a wedge-shaped form fit between the retention wall, on the one hand, and the shank part, on the other, has a depth which is not quite equal to the thickness of the shank part, i.e. the distance between the two surfaces running parallel to one another, so that compensation can be provided for tolerances in the dimensions of the shank part by clamping the retention block down to different depths.

The fastening bolts penetrating through the worm preferably terminate in blind holes in the retention block so that there is no danger of damage to the thread even in the case of severe abrasion. In addition, it is desirable to design these bolts as socket-head bolts and to countersink them in the wall of the worm.

In this way, damage to the bolt head by abrasion and the like is also substantially avoided so that no difficulties arise during later loosening of the retention bolts.

It has also be found very desirable to locate the retention boxes on the conveyor worm side wall which is not involved in the transport of the material.

This, firstly, provides a smooth flow of material along the conveyor worm and, secondly, the abrasion and hence wear of the retention box, in particular the retention shank, are substantially reduced and the renewal intervals for the retention boxes are thus substantially lengthened.

BRIEF DESCRIPTION OF THE DRAWINGS

Using a preferred illustrative example, the invention is explained below using the accompanying drawings, wherein.

DESCRIPTION OF THE PREFERRED EMBODIMENT

Figure 1:
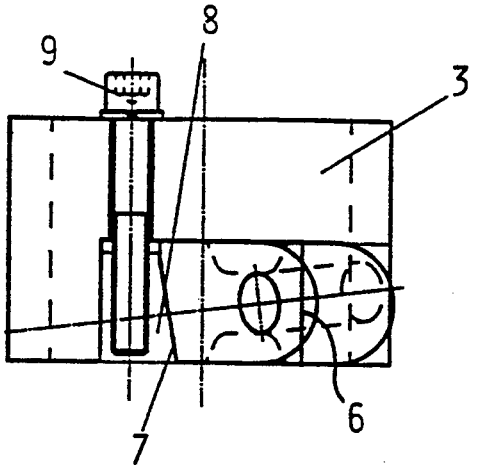
FIG. 1 is a plan view of the retention box located in a recess of the conveyor worm.
Figure 1:
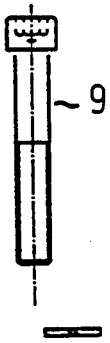

Referring now to the drawings, like reference numerals designate identical or corresponding parts throughout the several views. In the arrangement shown of the retention box 1 and the recess 2 of the conveyor worm 3, shown in part, the retention shank 4 of the retention box 1 is designed to be trapezoidal in section, i.e. it has two opposite parallel surfaces which are bounded, at one end, by a surface 6 joining them at right angles and, at the other, by a surface 7 joining them obliquely.

The retention shank 4 is then inserted into the cuboid-shaped recess 2 of the conveyor worm 3 in such a way that the longer side and the surface 6 connecting the parallel surfaces at right angles are in contact with the conveyor worm 3. Part of the cuboid-shaped recess then remains free and into this part is fitted the wedge-shaped retention block 8 with the threaded hole which terminates in a blind hole. The fastening bolt 9 is inserted from the back of the conveyor worm 3 through the hole 10 and is bolted into the threaded hole of the retention block 8. By this means, the retention block 8 is drawn in as a wedge into the cuboid-shaped recess 2 of the conveyor worm 3 and clamps the retention shank 4 of the retention box 1 in the recess 2.

Because the length of the retention block 8 is somewhat less than the depth of the recess 2 in the conveyor worm 3, the retention shank 4 can be reliably clamped in the recess 2 even in the case of large manufacturing tolerances. Only the exact shaping of the sides 11 and 12 of the cuboid-shaped recess 2 and the sides of the retention shank coming into contact with them are critical to the positioning of the retention shank 4 and the retention box 1, with the planing tool, connected to it.

Figure 2:
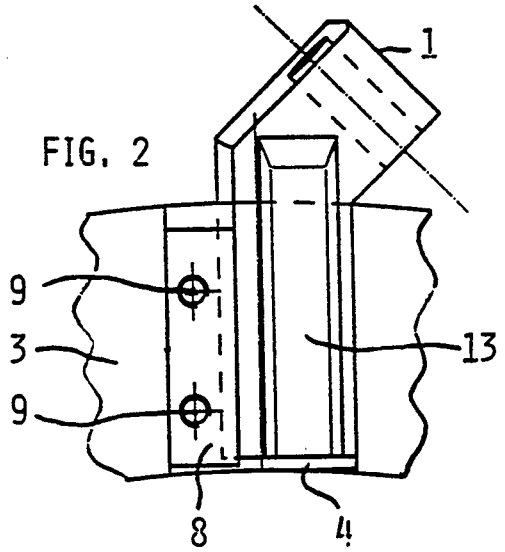
FIG. 2 is a side view of the retention box fastened in the recess of the conveyor worm.
Figure 3:
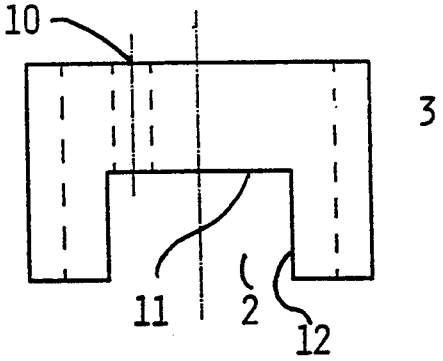
FIG. 3 is an exploded view of the parts necessary for fastening the retention box in the recess of the conveyor worm, in plan view.
Figure 3:
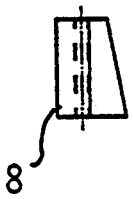
Figure 3:
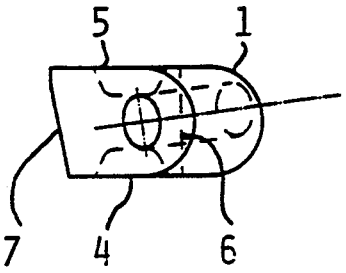

As may be seen from FIG. 2, the front narrow side of the retention shank 4 is provided in part with a protrusion 13, which may be rounded and which serves to increase the abrasion resistance of the retention shank 4.

In order to exchange the retention boxes, shown in FIGS. 1 and 2 in the bolted-up arrangement, it is only necessary to loosen the fastening bolts 9 by approximately one thread turn so that the wedge-shaped retention block 8 releases the shank 4 of the retention box so that the latter can be withdrawn in the radial direction from the recess 2.

After the new retention box has been inserted, it is only necessary to tighten the retention bolts 9 by one thread turn so that the wedge-shaped retention block again clamps the retention shank 4 firmly in the recess 2 of the conveyor worm 3.

What is claimed is:

1. A cutter apparatus for being positioned on a conveyor worm of a roller-type planing device for planing down road surfaces, said cutter apparatus having a multiplicity of planing tools which are arranged in releasable retention boxes, said retention boxes having shank parts in turn bolted into radial recesses defining side openings in the conveyor worm wherein at least one retention box at least partially covering the shank part is fastenable by bolts penetrating through the conveyor worm in order to retain the shank part of the respective retention box in the side opening of the conveyor worm.

2. Planing device as claimed in claim 1, wherein the side of the shank part (4) facing away from the retention block (8) is designed to be a form fit in the recess (2).

3. Planing device as claimed in claim 2, wherein the shank part (4) is bounded, on the side facing away from the retention block (8), by surfaces at right angles to one another.

4. Planing device as claimed in claim 3, wherein the retention block (8) is designed to be a form fit with the adjacent surface (7) of the shank part (4).

5. Planing device as claimed in claim 2 wherein the shank part (4) has a quadrilateral shape in section, the side facing towards the conveyor worm (3) being longer than the side facing away from the conveyor worm (3).

6. Planing device as claimed in claim 2, wherein the retention shank (4) is designed to be trapezoidal in section, the narrow side facing away from the conveyor worm (3).

7. Planing device as claimed in claim 2 wherein the front narrow side of the retention shank (4) is provided, at least in part, with a protrusion (13) which may be rounded.

8. Planing device as claimed in claim 1 wherein the shank (4) is of trapezium section with two adjacent right-angle corners, which section is so arranged in the rectangular section recess (2) of the conveyor worm (3) that the narrow side is directed away from the conveyor worm (3), the adjacent side at right angles represents the back of the retention shank (4), seen in the direction of rotation, and the retention block (8) is inserted and bolted in as a form fit and wedge between the wall of the recess (2) and the shank (4).

9. Planing device as claimed in claim 1 wherein the fastening bolts (9) extending through the conveyor worm (3) end in blind holes in the retention block (8) and are designed as socket-head bolts arranged to be countersunk in the wall of the conveyor worm (3).

10. Planing device as claimed in claim 1 wherein the retention boxes (1) are located on the side wall of the conveyor worm (3) which is ineffective with reference to the transport of the material conveyed.

* * * * *